US009909399B2

(12) United States Patent
Russell et al.

(10) Patent No.: US 9,909,399 B2
(45) Date of Patent: Mar. 6, 2018

(54) FLOW DEVICE AND METHODS OF CREATING DIFFERENT PRESSURE DROPS BASED ON A DIRECTION OF FLOW

(71) Applicants: Ronnie D. Russell, Cypress, TX (US); Elmer Richard Peterson, Porter, TX (US)

(72) Inventors: Ronnie D. Russell, Cypress, TX (US); Elmer Richard Peterson, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 312 days.

(21) Appl. No.: 14/474,861

(22) Filed: Sep. 2, 2014

(65) Prior Publication Data

US 2016/0060966 A1 Mar. 3, 2016

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS 8,403,038 B2 3/2013 Russell et al.
8,403,061 B2 3/2013 Russell et al.
8,527,100 B2 9/2013 Russell et al.
2011/0079387 A1 4/2011 Russell et al.
2011/0139453 A1 6/2011 Schultz et al.
2011/0186300 A1 8/2011 Dykstra et al.
2012/0145385 A1 6/2012 Lopez
2016/0061373 A1 3/2016 Russell et al.

FOREIGN PATENT DOCUMENTS

WO 2013085496 A1 6/2013

OTHER PUBLICATIONS

High Pressure 375 Flow Control FHRA3755200I Product details, 2011, Retrieved on Aug. 6, 2015. Retrieved from the internet, www.theleeco.com. 1 page.
Notification of Transmittal of the International Search Report and the Written Opinion of the International Searching Authority, or the Declaration; PCT/US2015/045578; dated Nov. 4, 2015: 16 pages.

*Primary Examiner* — D. Andrews
*Assistant Examiner* — Kristyn A Hall
(74) *Attorney, Agent, or Firm* — Cantor Colburn LLP

(57) ABSTRACT

A flow device, includes a flow-through region comprising at least one stage and configured to create a first pressure drop across the flow-through region in response to flow through the flow-through region in a first direction and a second pressure drop in response to flow through the flow-through region in a second direction. The first pressure drop being less than the second pressure drop under the same flow rates. The flow device having no moving parts to create the difference in pressure drop between the first direction and the second direction. A method of creating different pressure drops based on a direction of flow.

23 Claims, 8 Drawing Sheets

FLOW DEVICE AND METHODS OF CREATING DIFFERENT PRESSURE DROPS BASED ON A DIRECTION OF FLOW

BACKGROUND

Flow control devices in tubular systems are employed for a multitude of purposes. One such purpose, as employed in the hydrocarbon recovery industry, is to equalize production flow across a length of wellbore to more evenly and thoroughly empty multiple reservoirs distributed along the wellbore. Without the inflow control devices, portions of the formation having higher permeability and thus higher flow rates could become depleted of hydrocarbon sooner than other portions of the formation that have lower permeability. Once depleted of hydrocarbon those portions of the formation may begin producing water that needs to be separated from the hydrocarbon at a later time. This separation is a costly and time consuming operation. Although conventional flow control devices serve the purpose for which they were designed; they can create undesirable restrictions to flow in a direction opposite to that of the produced fluids. Such flow restrictions can slow flow rates of treating fluids being pumped therethrough and hinder proper formation treatment in the process. The industry is therefore always receptive to new devices and methods that alleviate such undesirable characteristics of conventional inflow control devices.

BRIEF DESCRIPTION

A flow device, includes a flow-through region comprising at least one stage and configured to create a first pressure drop across the flow-through region in response to flow through the flow-through region in a first direction and a second pressure drop in response to flow through the flow-through region in a second direction, the first pressure drop being less than the second pressure drop under the same flow rates, the flow device having no moving parts to create the difference in pressure drop between the first direction and the second direction.

A method of creating different pressure drops based on a direction of flow, includes flowing fluid at a set flow rate through a flow-through region of a flow device in a first direction through a first opening into a pocket and out of the pocket through a second opening and creating a first pressure drop in the process; and flowing fluid at the set flow rate through the flow-through region of the flow device in a second direction through the second opening into the pocket and out of the pocket through the first opening and creating a second pressure drop in the process, the first pressure drop being less than the second pressure drop with no part moving within the first opening, the second opening or the pocket to create the difference in pressure drop.

A method of creating different pressure drops based on a direction of flow, includes flowing fluid at a set flow rate through a flow-through region of a flow device in a first direction through a first opening into a pocket and out through a second opening; accelerating fluid as it flows through at least one of the first opening and the second opening with a decrease in a cross sectional flow area of the at least one first opening and second opening and creating a first pressure drop in the process; flowing fluid at the set flow rate through the flow-through region of the flow device in a second direction through the second opening into the pocket and out through the first opening; and decelerating fluid as it flows through at least one of the second opening and the first opening with an increase in a cross sectional flow area of the at least one second opening and first opening and creating a second pressure drop in the process, the first pressure drop being less than the second pressure drop.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
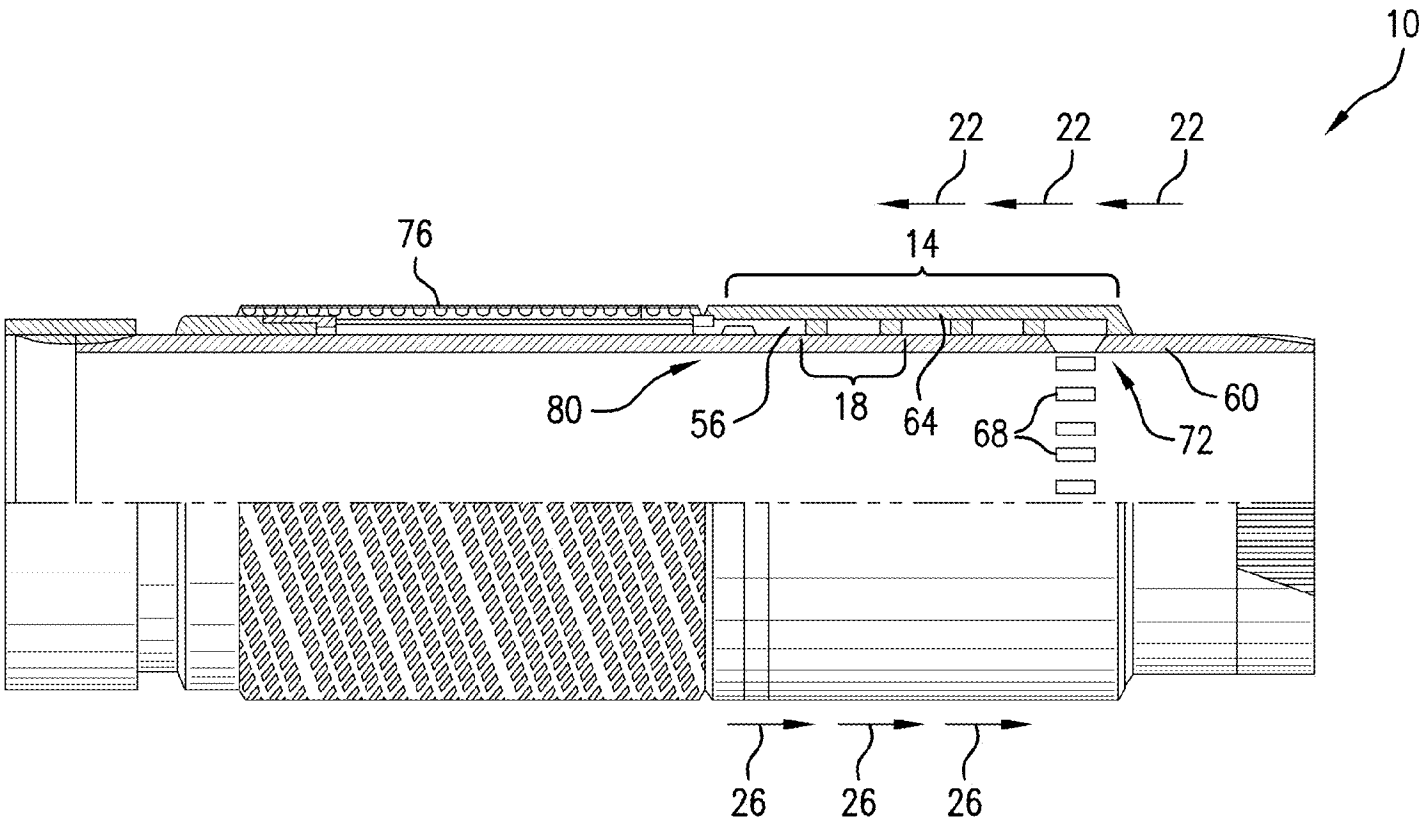
FIG. 1 depicts a quarter cross sectional view of a flow device disclosed herein.
Figure 2:
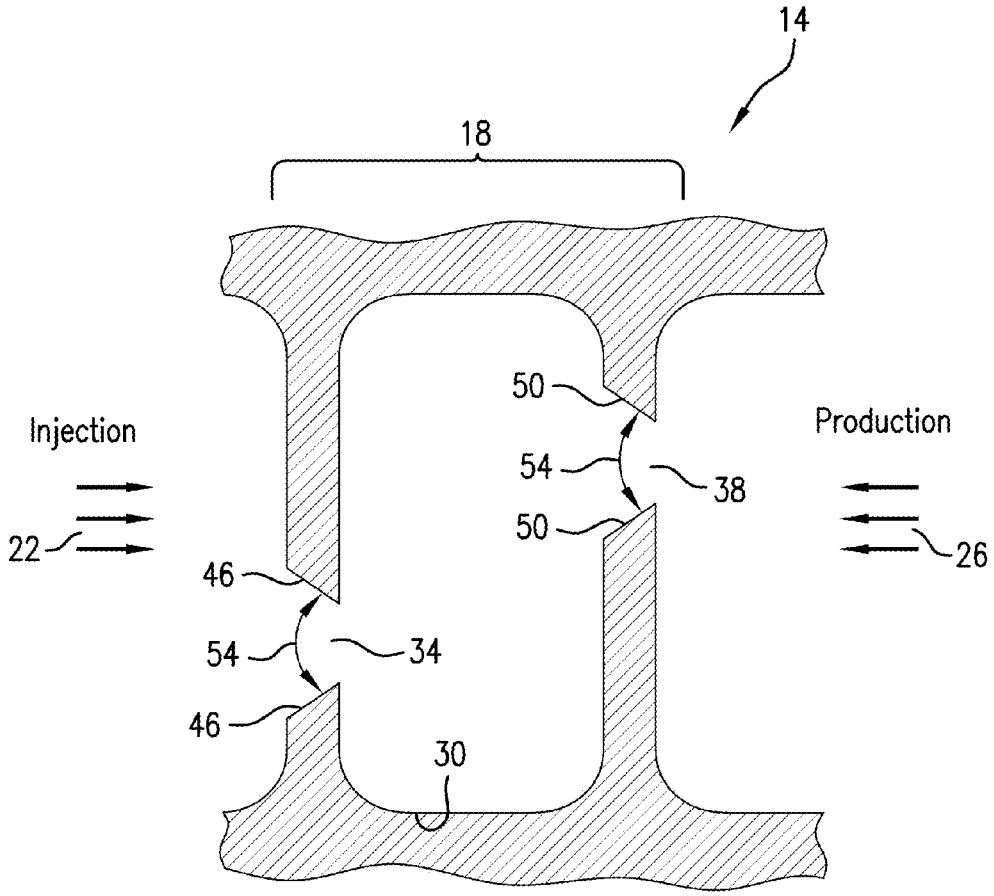
FIG. 2 depicts a partial cross sectional view through one of the stages of the flow device of FIG. 1.
Figure 3:
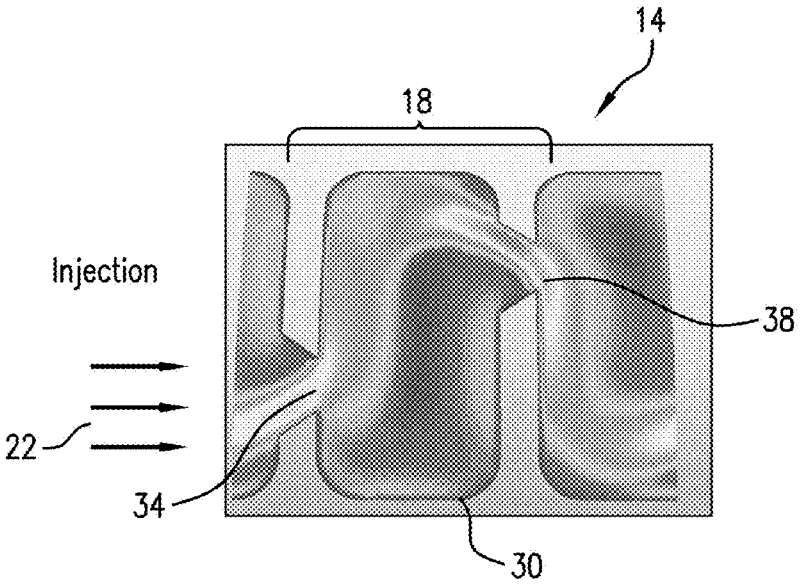
FIG. 3 depicts a print out of a computational fluid dynamics analysis of fluid flowing through the stage of FIG. 2 in a first direction.
Figure 4:
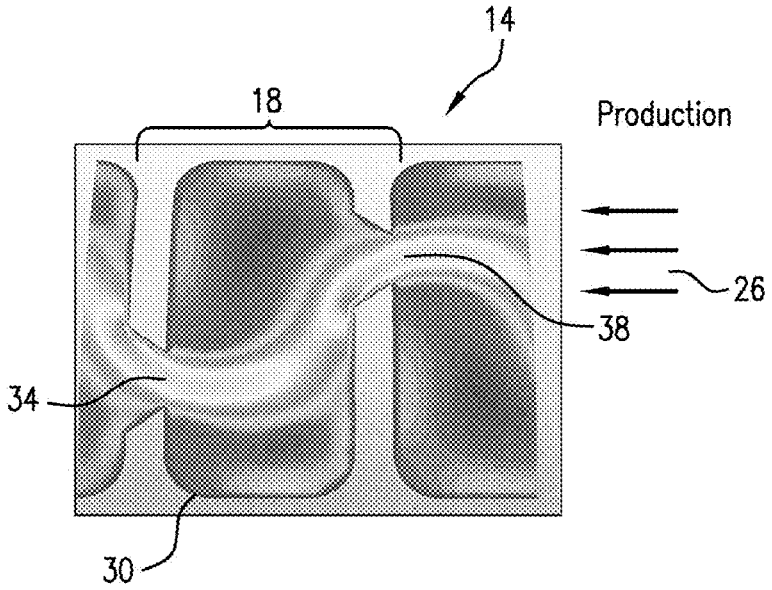
FIG. 4 depicts a print out of a computational fluid dynamics analysis of fluid flowing through the stage of FIG. 2 in a second direction.

A detailed description of one or more embodiments of the disclosed apparatus and method are presented herein by way of exemplification and not limitation with reference to the Figures.

Referring to FIG. 1-4, a flow device disclosed herein is illustrated at 10. The flow device 10 includes, a flow-through region 14 having at least one stage 18 (with just one stage being shown in FIG. 2-4) and configured to create a first pressure drop across the flow-through region 14 in response to flow through the flow-through region 14 being in a first direction depicted by arrows 22, and a second pressure drop in response to flow through the flow-through region 14 being in a second direction depicted by arrows 26. The flow device 10 requires no moving parts to create the difference in pressure drop between the first direction and the second direction.

The stage 18, illustrated in the Figures has a pocket 30. A first opening 34 and a second opening 38 fluidically connect the pocket 30 to other pockets 42 and serve as inlets and outlets to the pocket 30. A flow area through the pocket 30 is larger than a flow area through either of the first opening 34 or the second opening 38. Additionally, a flow area of both the first opening 34 and the second opening 38 varies in a direction of fluid flow therethrough. For example, walls 46 of the first opening 34 are tapered such that flow area of the first opening 34 decreases along the direction of arrows 22. Similarly, walls 50 of the second opening 38 are also tapered such that a flow area of the second opening 38 decreases along the direction of arrows 22. As such, the walls 46, 50 are tapered in a same direction relative to flow.

In one embodiment the pocket 30, the first opening 38 and the second opening 38 are positioned within an annular space 56 defined between a first tubular 60 and a second tubular 64. The walls 46, 50 can be formed in either the first tubular 60, the second tubular 64 or on a separate part positioned within the annular space 56. Flow enters and exits the annular space 56 through ports 68 in the first tubular 60 on one longitudinal end 72 and through a screen 76 on an opposing longitudinal end 80 of the annular space 56.

In one embodiment an included angle 54 between the walls 46 and 50 of the openings 34 and 38 respectively measure in a range of about 40 to 90 degrees. Evaluation of the embodiment predicts difference in pressure drop across the flow-through region 14 made of six of these stages 18 in series that is between about 55 and 60 percent less in the first direction than in the second direction, with all other parameters being equal. Some parameters employed during one particular evaluation included a flow rate of 200 barrels per day of oil (1.8 cP, 0.86 SG). It should be noted that by assembling a plurality of the stages 18 in series one can create even greater differences in pressure drop between flow in the first direction and flow in the second direction.

The flow-through region 14 creates the difference in pressure drop between the first direction and the second direction at least in part by accelerating (over a reducing area) and decelerating (over an expanding area) fluid flowing through the openings 34, 38 with the changes in flow area defined by the tapered walls 46, 50.

Figure 5:
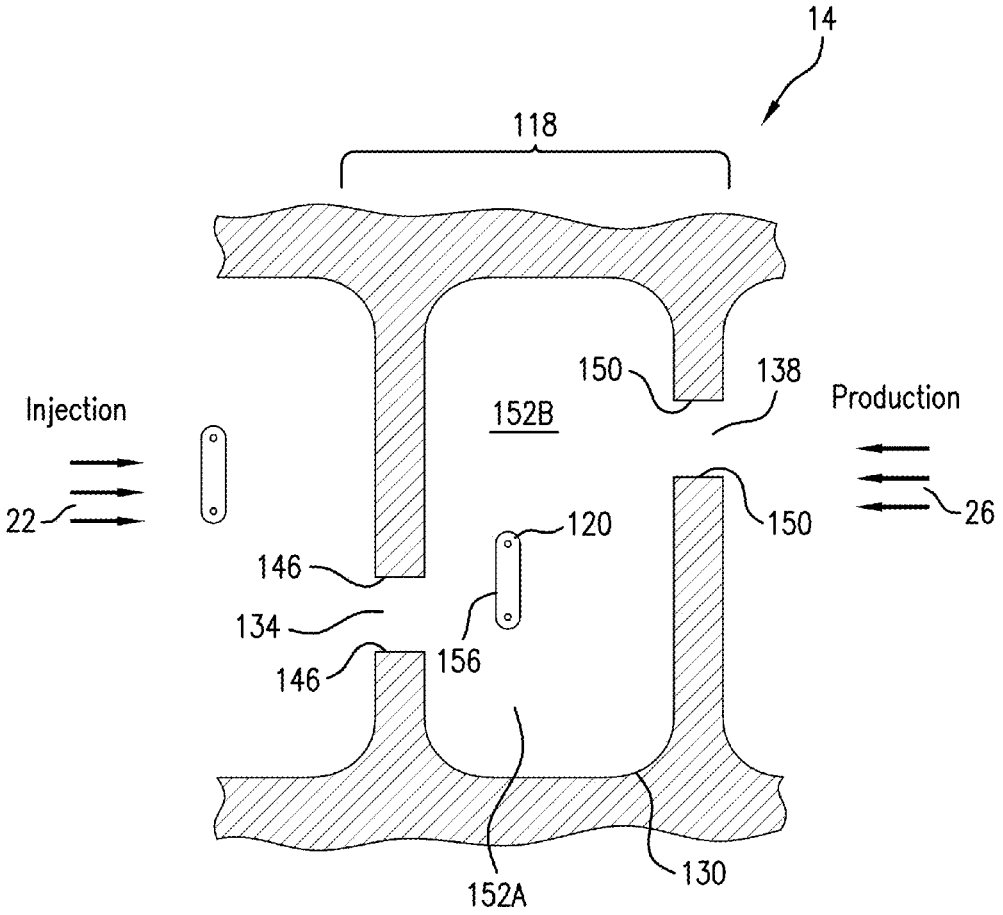
FIG. 5 depicts a partial cross sectional view through an alternate embodiment of stage disclosed herein.
Figure 6:
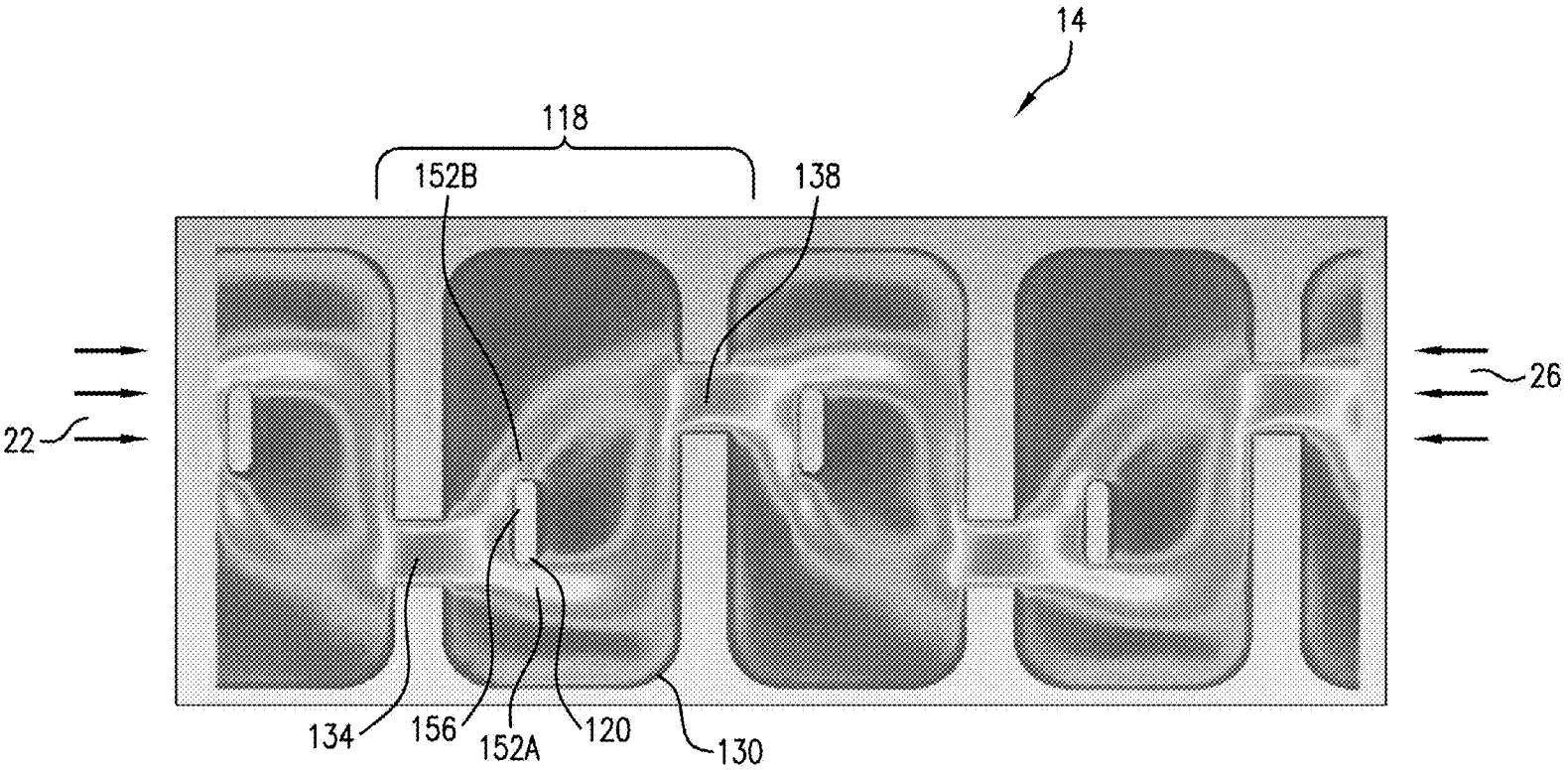
FIG. 6 depicts a print out of a computational fluid dynamics analysis of fluid flowing through the stage of FIG. 5 in a first direction.

Referring to FIGS. 5 and 6, an alternate embodiment of a stage employable in the flow-through region 14 of the flow device 10 is illustrated at 118. The stage 118 differs in that a baffle 120 is positioned within a pocket 142 and walls 146 and 150 of a first opening 134 and a second opening 138 respectively, are not tapered but are parallel instead. Although it should be noted that the walls 146, 150 could be tapered (as are the walls 46 and 50) in addition to having the baffle 120. The baffle 120 is positioned nearer to the first opening 134 than the second opening 138 in a pocket 130 and is at least partially aligned with the first opening 134. As such, fluid flowing into the pocket 130 through the first opening 134 impinges against the baffle 120. In one embodiment the baffle 120 is configured such that it divides flow through the pocket 130 into two channels 152A and 152B, one being to either side of the baffle 120. This configuration has shown through computational fluid dynamics simulation to be effective in creating less pressure drop to fluid flowing through the stage 118 in the first direction than in the second direction.

The baffle 120 of one embodiment presents a straight surface 156 that is oriented perpendicular to flow entering the pocket 130 from the first opening 134. In the illustrated embodiment more than half of the baffle 120 overlaps with the first opening 134, although in other embodiments more or less overlap could be employed, as could angles of the baffle 120 relative to the first opening 134.

Figure 7:
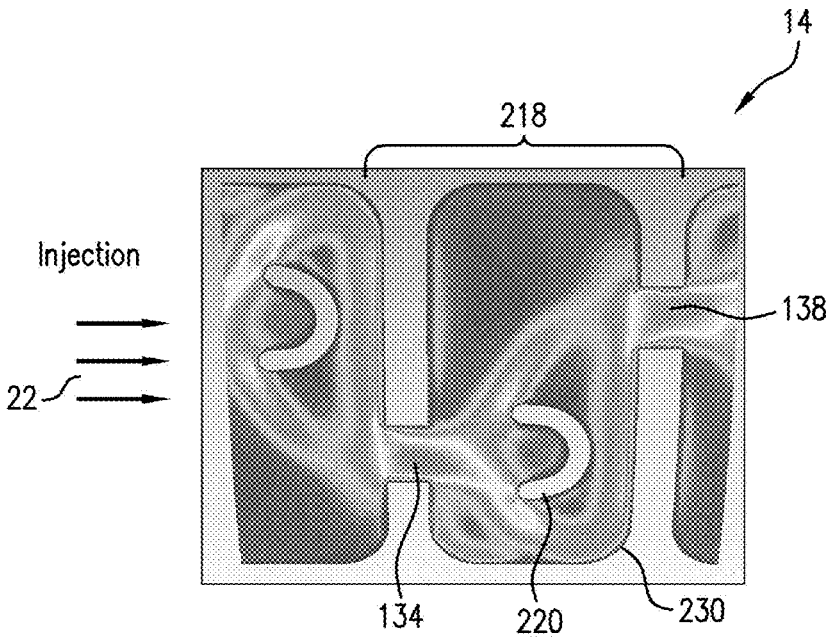
FIG. 7 depicts a print out of a computational fluid dynamics analysis of fluid flowing through an alternate stage disclosed herein in a first direction.
Figure 8:
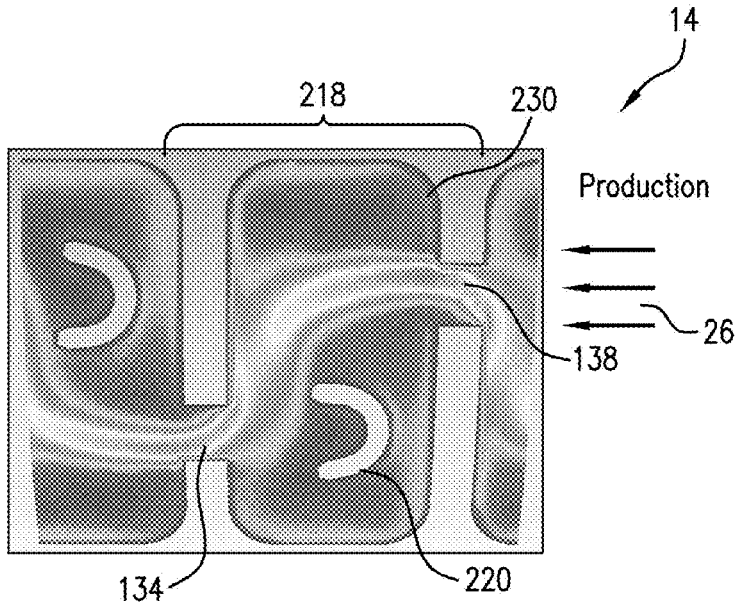
FIG. 8 depicts a print out of a computational fluid dynamics analysis of fluid flowing through the stage of FIG. 7 in a second direction.

Referring to FIGS. 7 and 8, an alternate embodiment of a stage employable in the flow-through region 14 of the flow device 10 is illustrated at 218. Like the stage 118 the stage 218 also includes a baffle 220 that is located within a pocket 230 that is nearer to the first opening 134 than the second opening 138. One difference in the stage 218 is a shape of the baffle 220. The baffle 220 is "U" shaped. The concave side of the "U" faces the first opening 134. The baffle 220 splits flow in the first direction of arrows 22 entering through the first opening 134 into two separate flow streams. In contrast, flow that enters the pocket 230 in the second direction of arrows 26 through the second openings 138 does not impinge on the baffle 220 directly and as such is not forced to split. This difference is partially responsible for the lower pressure drop through the stage 218 in the first direction as opposed to the second direction. While the baffle 220 has the specific "U" shape oriented in a specific direction, it should be noted that other embodiments can have different shapes that are oriented differently to present a variety of surfaces that face the first opening 134. For example, the baffle 220 can be oriented such that a convex side or any other side is facing the first opening 134. Alternately, baffles can be employed that are round, oval, polyhedral, or have a zigzagged shape, for example, or even have combinations of two or more of the foregoing.

Figure 9:
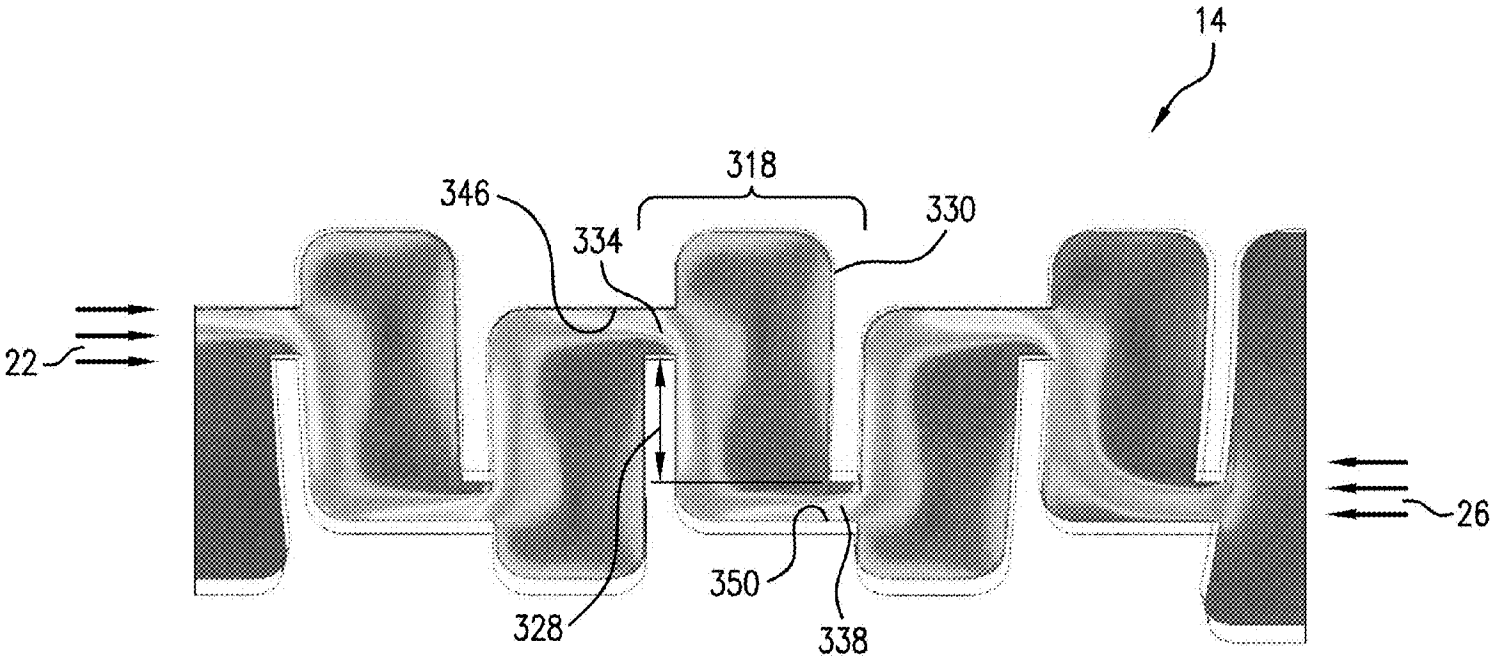
FIG. 9 depicts a print out of a computational fluid dynamics analysis of fluid flowing through the stage of an alternate stage disclosed herein in a second direction.

Referring to FIG. 9, another embodiment of a stage employable in the flow-through region 14 of the flow device 10 is illustrated at 318. The stages 318 do not include a baffle but instead have a first opening 334 that is offset a dimension 328 relative to a second opening 338 in a pocket 330. The offset dimension 328 is greater than an amount of offset in the other embodiments disclosed herein. In fact, the offset dimension 328 is sufficiently large to result in a wall 346 being common with both the first opening 334 and the pocket 330. Similarly, although optionally, a wall 350 also is common with both the second opening 338 and the pocket 330. As such stage 318 is also configured to cause less pressure drop to fluid flowing therethrough in a first direction along arrows 22 than in a second direction along arrows 26.

Figure 10:
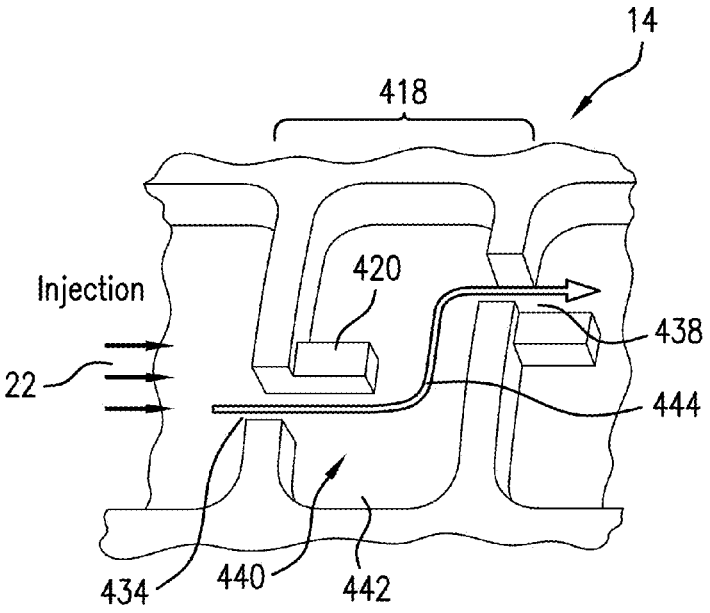
FIG. 10 depicts a perspective view of a stage disclosed herein with an arrow representing fluid flowing therethrough in a first direction.
Figure 11:
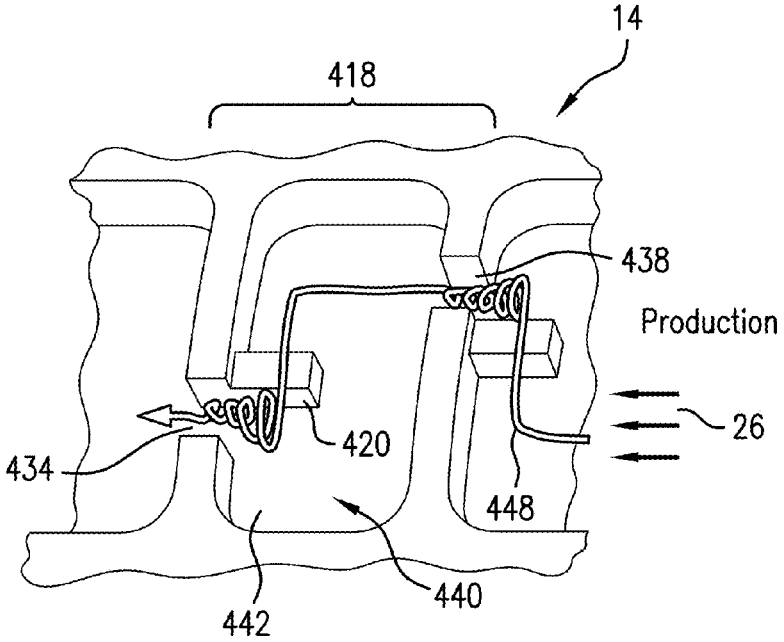
FIG. 11 depicts a perspective view of the stage of FIG. 10 with an arrow representing fluid flowing therethrough in a second direction.

Referring to FIGS. 10 and 11, another embodiment of a stage employable in the flow-through region 14 of the flow device 10 is illustrated at 418. The stage 418 includes an offset pad 420 positioned adjacent to a first opening 434 that is attached to a surface 440 of a pocket 442 through which fluid flows between the first opening 434 and a second opening 438. Fluid flowing in through the first opening 434 in a direction of arrows 22 is substantially unaltered by the presence of the pad 420 as shown by the arrow 444 in FIG. 10. However flow in a direction of arrows 26 into the pocket 442 through the second opening 438 is altered by the presence of the pad 420. This alteration in flow will likely induce a vortex as depicted by arrow 448 in FIG. 11. The vortex can increase a pressure drop thereby resulting in the stage 418 having a greater pressure drop when fluid flows through the pocket 442 in the direction of arrows 26 than in the direction of arrows 22.

It should be appreciated that in other embodiments an alternate pad could be employed that is not attached to the surface 440 but instead leaves a small clearance therebetween. Similarly, other embodiments could have a pad that spans a thickness of the pocket 442 to essentially attach or abut with the surface 440 as well as a surface positioned opposite the surface 440 of the pocket 442. Alternatively, offset pad 420 may be offset a short distance from first opening 434 as opposed to being adjacent to first opening 434 and still achieve a desirable result.

Although the features of the stages 18, 118, 218, 318, 418 are shown separately, other embodiments can employ any two or more of the features disclosed herein that are compatible within a single embodiment. Analysis has shown that embodiments of the flow device 10 employing one or more of the features in the stages 18, 118, 218, 318, 418 can result in pressure drops in the first direction that are in a range of 40 to 60 percent of the pressure drop in the second direction.

In downhole applications, such as for hydrocarbon recovery for example, the flow device 10 allows and operator to use a plurality of just this one flow device 10 (possibly with some set at different levels of pressure drop differential than others) with no moving parts to inject fluids into an earth formation with very little restriction, while also having sufficient restriction to equalize production flow therethrough in the opposing direction.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A wellbore flow device, comprising:

a flow-through region comprising at least one stage and configured to create a first pressure drop across the flow-through region in response to flow through the flow-through region in a first direction and a second pressure drop in response to flow through the flow-through region in a second direction, the first pressure drop being less than the second pressure drop under the same flow rates, the device including at least two pockets each having a defined area that is fluidly accessible through only a first opening, and a second opening offset from the first opening on opposing walls of the pocket and requiring all fluid flow through the at least two pockets to travel in a zig-zag pattern in both the first and second flow directions, each pocket having a baffle configured and positioned to be nearer the first opening than the second opening within the respective pocket and at least partially aligned with the first opening and misaligned with the second opening such that flow in the first direction impinges the baffle and splits, and the flow in the second direction bypasses the baffle and does not split.

2. The flow device of claim 1, wherein the at least one stage includes a pocket having a larger cross sectional flow area than a first opening and a second opening fluidically connected to the pocket.

3. The flow device of claim 2, wherein the first opening and the second opening serve as inlets and outlets to the pocket.

4. The flow device of claim 2, wherein a baffle is positioned nearer to the first opening than the second opening.

5. The flow device of claim 4, wherein the baffle has a shape from the group consisting of "U" shaped, round, oval, polyhedral, zigzagged shaped, or combinations of two or more of the foregoing.

6. The flow device of claim 4, wherein the baffle splits the flow through the pocket into multiple flows.

7. The flow device of claim 4, wherein the flow device is configured such that pressure drop through the pocket is less in the first direction than in a second direction when flow in the first direction is defined as being into the pocket through which ever of the first opening and the second opening is nearer to the baffle and the second direction is opposite the first direction.

8. The flow device of claim 2, wherein walls defining at least one of the first opening and the second opening are tapered relative to a direction of flow through the at least one of the first opening and the second opening.

9. The flow device of claim 8, wherein walls defining both the first opening and the second opening are tapered in a same direction relative to a direction of flow through both the first opening and the second opening.

10. The flow device of claim 2, wherein at least one of the first opening and the second opening has a wall that is common with the pocket.

11. The flow device of claim 1, wherein the first pressure drop is in a range of about 40 to 60 percent of the second pressure drop with all other things being equal.

12. The flow device of claim 1, wherein flow in the first direction is for treating an earth formation and flow in the second direction is for production from the earth formation.

13. The flow device of claim 1, wherein a pad is positioned nearer to the first opening than the second opening such that flow through the flow device is altered more by the pad when flow is into the flow device through the second opening than when flow is into the flow device through the first opening.

14. The flow device of claim 1, wherein, the flow device includes no moving parts to create the difference in pressure drop between the first direction and the second direction.

15. A method of creating different pressure drops based on a direction of flow through a wellbore flow device having at least two pockets, comprising:

flowing fluid at a set flow rate through a flow-through region of a flow device in a first direction through a first opening into a pocket having a defined area that is fluidly accessible through only the first opening and a second opening, the first opening and second opening being on opposing walls of the pocket, each pocket having a baffle therein configured and positioned to be nearer the first opening than the second opening within the respective pocket and at least partially aligned with the first opening and impinged by the flow in the first direction, splitting the flow, and out of the pocket through a second opening offset from the first opening, the structure requiring the flow to occur in a zig-zag pattern and creating a first pressure drop in the process; and flowing fluid at the set flow rate through the flow-through region of the flow device in a second direction through the second opening into the pocket, the flow in the second direction bypassing the baffle, and not splitting the flow, and out of the pocket through the first opening, the structure requiring the flow to occur in a zig-zag pattern and creating a second pressure drop in the process, the first pressure drop being less than the second pressure drop.

16. The method of creating different pressure drops based on a direction of flow of claim 15, further comprising impinging a baffle nearer to the first opening than to the second opening with fluid entering the pocket.

17. The method of creating different pressure drops based on a direction of flow of claim 16, further comprising splitting fluid flowing through the first opening into two flow paths with the baffle.

18. The method of creating different pressure drops based on a direction of flow of claim 16, further comprising impinging a flat surface of the baffle with fluid flowing through the first opening.

19. The method of creating different pressure drops based on a direction of flow of claim 16, further comprising impinging a curved surface of the baffle with fluid flowing through the first opening.

20. The method of creating different pressure drops based on a direction of flow of claim 16, further comprising impinging a concave surface of the baffle with fluid flowing through the first opening.

21. The method of creating different pressure drops based on a direction of flow of claim 16, further comprising impinging a convex surface of the baffle with fluid flowing through the first opening.

22. The method of creating different pressure drops based on a direction of flow of claim 15, further comprising altering flow in the second direction greater than in the first direction with a pad positioned nearer to the first opening than to the second opening.

23. The method of creating different pressure drops based on a direction of flow of claim 15, further comprising creating the first pressure drop that is less than the second pressure drop without moving parts within the first opening, the second opening or the pocket to create the difference in pressure drop.

* * * * *